US011648452B1

(12) United States Patent
Zhang

(10) Patent No.: US 11,648,452 B1
(45) Date of Patent: May 16, 2023

(54) AUXILIARY TOOL FOR BARBELLS AND ANTI-SLIP METHOD FOR BARBELLS DURING USE

(71) Applicant: Xiamen Shouxi Sports Technology Co., Ltd, Xiamen (CN)

(72) Inventor: Caifeng Zhang, Sanming (CN)

( * ) Notice: Subject to any disclaimer, the term of this patent is extended or adjusted under 35 U.S.C. 154(b) by 0 days.

(21) Appl. No.: 17/994,032

(22) Filed: Nov. 25, 2022

(51) Int. Cl.
*A63B 21/072* (2006.01)
*A63B 71/00* (2006.01)

(52) U.S. Cl.
CPC ..... *A63B 71/0054* (2013.01); *A63B 21/0724* (2013.01); *A63B 2071/009* (2013.01)

(58) Field of Classification Search
None
See application file for complete search history.

(56) References Cited

U.S. PATENT DOCUMENTS 605,747 A * 6/1898 Sachs ..... A63B 21/0615 482/109
3,690,655 A * 9/1972 Chapman ..... A63B 23/14 482/109
5,071,279 A * 12/1991 Rutstrom ..... F16M 11/14 403/114
5,207,624 A * 5/1993 Paskovich ..... A63B 21/072 482/109
5,971,891 A * 10/1999 Humphrey ..... A63B 23/03575 482/54
8,888,666 B2 * 11/2014 Quader ..... A63B 21/0608 482/121
8,974,354 B1 * 3/2015 Nelson ..... A63B 21/08 482/94
9,289,646 B2 * 3/2016 Tully ..... A63B 23/03525
10,118,066 B2 * 11/2018 Clerk ..... A63B 21/08
10,434,353 B1 * 10/2019 Fabbri ..... A63B 21/00185
11,278,760 B1 * 3/2022 Hutchinson ..... A63B 21/4035
2011/0251026 A1 * 10/2011 Stephan ..... A63B 21/4047 482/93

* cited by examiner

*Primary Examiner* — Joshua Lee
(74) *Attorney, Agent, or Firm* — Rumit Ranjit Kanakia

(57) ABSTRACT

Disclosed are an auxiliary tool for barbells and an anti-slip method for barbells during use. The auxiliary tool comprises a sleeve which is composed of a first sleeve, a second sleeve, a third sleeve, a first sleeve wall, a second sleeve wall and a third sleeve wall, wherein the first sleeve wall is sequentially connected to the second sleeve wall and the third sleeve wall to form a complete sleeve cavity, the first sleeve wall and the third sleeve wall cover at least one part of a barbell bar, and the second sleeve wall expands outwards in the sleeve cavity to form an inner cavity; when the barbell bar is sequentially inserted into the first sleeve, the second sleeve and the third sleeve from a sleeve opening, the inner cavity is filled with gas to form a crush-resistant cavity; and protrusions are formed in an inner wall of the third sleeve, and a vent hole is formed in a bottom wall of the third sleeve. The auxiliary tool for barbells is small in size and convenient to carry and use, can be disposed around a barbell bar to serve as a fulcrum to allow trainers to make different lifting motions without being limited by the field, and can provide multiple training angles.

11 Claims, 6 Drawing Sheets

AUXILIARY TOOL FOR BARBELLS AND ANTI-SLIP METHOD FOR BARBELLS DURING USE

BACKGROUND OF THE INVENTION

1. Technical Field

The invention relates to an auxiliary tool for barbells and an anti-slip method for barbells during use.

2. Description of Related Art

Barreled barbells are fitness equipment which fulfills training by lifting a barbell bar inserted into a barrel, and different muscle groups can be trained through different lifting motions. The barreled barbells have good performance in training core strength, explosive force of limbs and physical coordination. According to existing barreled barbells, the barrel is generally fixed on the ground or the wall, after being inserted into the barrel, the barbell bar can be lifted only by a few angles and can be lifted merely in the vertical direction, and the trained positions are limited, so using is inconvenient.

BRIEF SUMMARY OF THE INVENTION

In view of the aforementioned defects, the objective of the invention is to provide an auxiliary tool for barbells and an anti-slip method for barbells during use.

To fulfill the above objective, the invention provides an auxiliary tool for barbells, comprising a sleeve which is composed of a first sleeve, a second sleeve, a third sleeve, a first sleeve wall, a second sleeve wall and a third sleeve wall, wherein the first sleeve wall is sequentially connected to the second sleeve wall and the third sleeve wall to form a complete sleeve cavity, the first sleeve wall and the third sleeve wall cover at least one part of a barbell bar, and the second sleeve wall expands outwards in the sleeve cavity to form an inner cavity; when the barbell bar is sequentially inserted into the first sleeve, the second sleeve and the third sleeve from a sleeve opening, the inner cavity is filled with gas to form a crush-resistant cavity; and protrusions are formed in an inner wall of the third sleeve, and a vent hole is formed in a bottom wall of the third sleeve.

As a further improvement of the invention, the first sleeve wall, the second sleeve wall and the third sleeve wall are formed integrally.

As a further improvement of the invention, a wall thickness of the first sleeve wall 21 increases gradually towards the second sleeve wall 22.

As a further improvement of the invention, the sleeve is made of an elastic material, which may be rubber or other high-elasticity polymer materials.

As a further improvement of the invention, anti-slip lines are disposed on an outer wall of the sleeve, and the anti-slip lines are honeycomb-shaped or striped.

As a further improvement of the invention, an air hole communicated with the vent hole in the bottom wall of the third sleeve is formed in an outer wall of the sleeve, and an inner diameter of the air hole is less than that of the vent hole.

To fulfill the above objective, the invention further provides an anti-slip method for barbells during use. The anti-slip method for barbells during use comprises: providing an anti-slip bushing, disposing the anti-slip bushing around an end of a barbell bar, and forming a pressurizing cavity in a middle section of the anti-slip bushing; when the barbell bar is inserted into a bottom of the anti-slip bushing, filling the pressurizing cavity with gas to enable a portion, corresponding to the pressurizing cavity, of an outer surface of the anti-slip bushing contact a ground, such that the end of the barbell bar is prevented from directly applying a pressure to the anti-slip bushing; and disposing anti-slip lines on the outer surface of the anti-slip bushing to increase the friction between the anti-slip bushing and the ground, such that an anti-slip effect is realized.

Compared with the prior art, the invention has the following beneficial effects: the auxiliary tool for barbells is small in size and convenient to carry and use and can be disposed around a barbell bar to serve as a fulcrum; the anti-slip lines on the outer surface of the auxiliary tool make the friction between the auxiliary tool and the ground large, such that slipping is unlikely to happen; through the protrusions in the auxiliary tool, the barbell bar is unlikely to rotate or slide with respect to the tool when disposed in the tool; through the vent hole in the auxiliary tool, the barbell bar can be inserted into the auxiliary tool more easily; the crush-resistant cavity formed in the auxiliary tool can prevent the end of a barbell from directly applying a pressure to the auxiliary tool, such that trainers can make different lifting motions without being limited by the field; and the auxiliary tool does not need to be fixed on a wall or the ground, thus providing more training angles.

Figure 1:
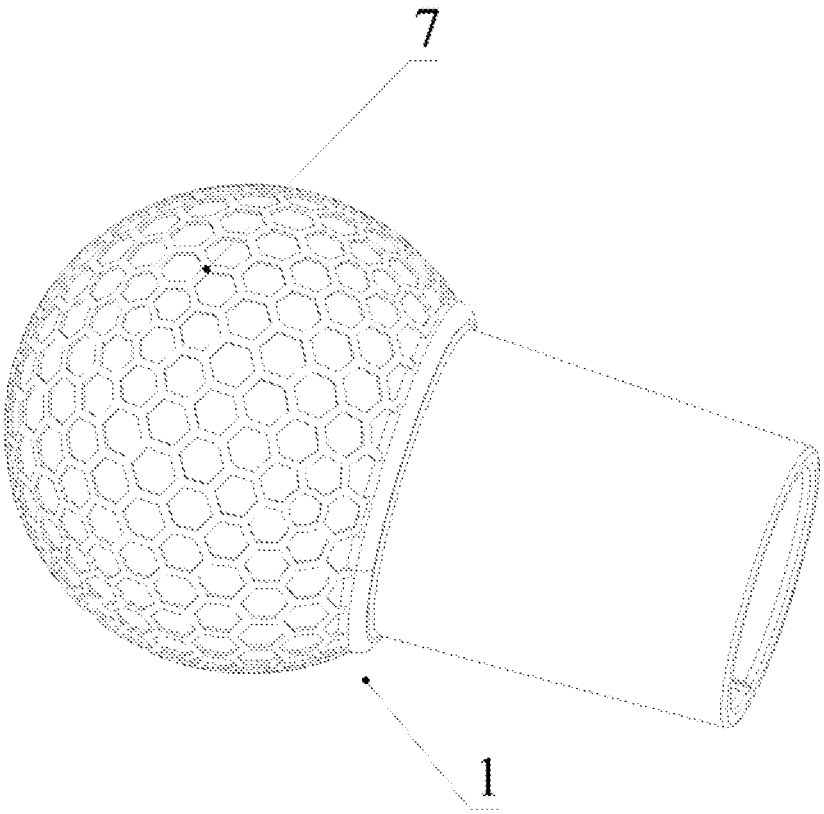
FIG. 1 is a three-dimensional view of an auxiliary tool for barbells according to the invention.
Figure 2:
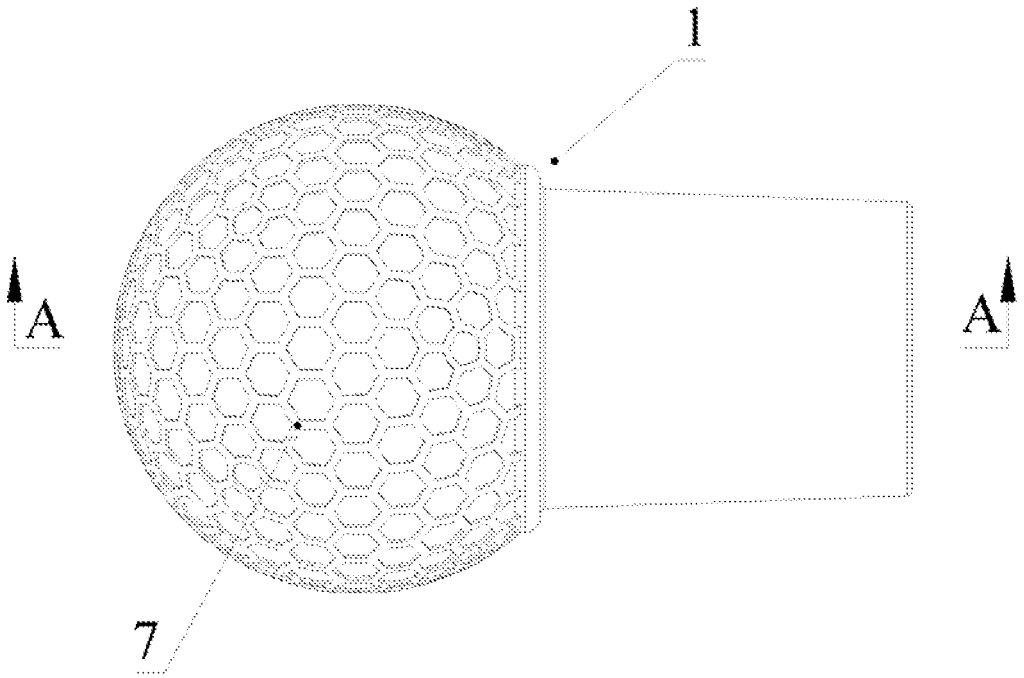
FIG. 2 is a front view of the auxiliary tool for barbells according to the invention.
Figure 3:
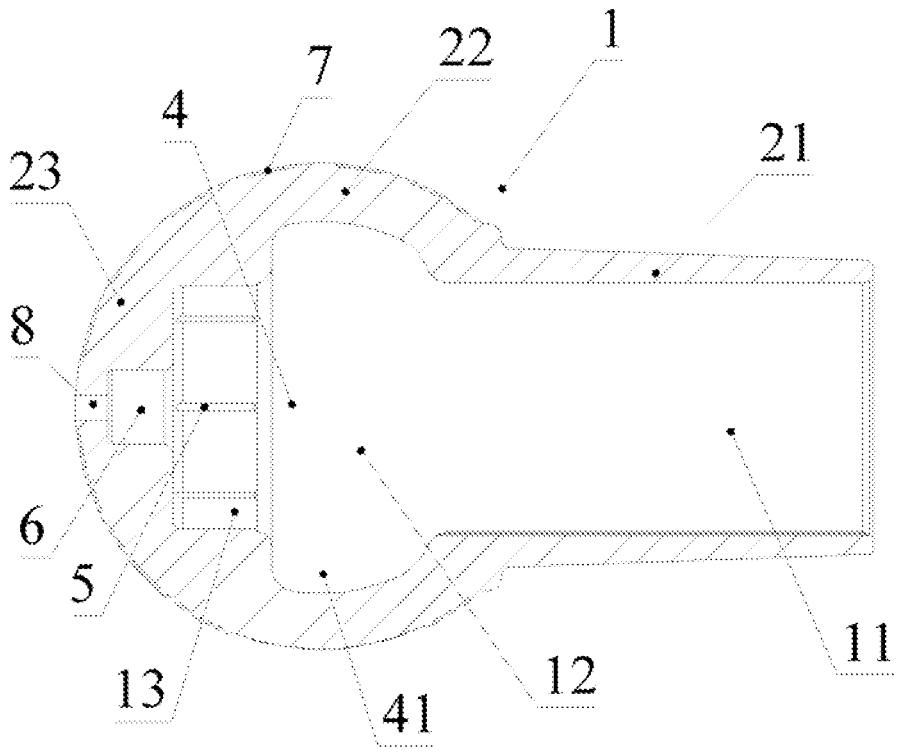
FIG. 3 is a sectional view along A-A in FIG. 2.
Figure 4:
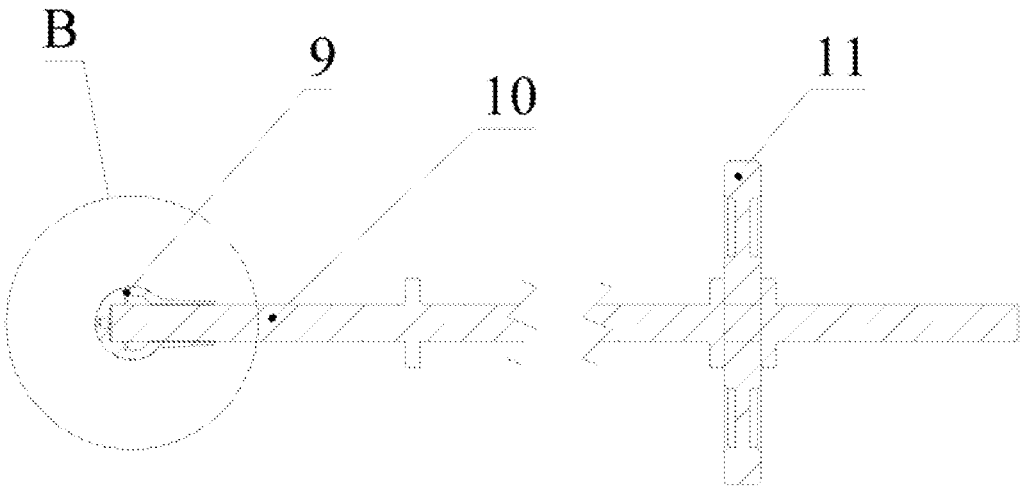
FIG. 4 is a schematic diagram of an anti-slip method for barbells during use according to the invention.

In the figures: 1, sleeve; 11, first sleeve; 12, second sleeve; 13, third sleeve; 21, first sleeve wall; 22, second sleeve wall; 23, third sleeve wall; 4, sleeve cavity; 41, inner cavity, pressurizing cavity; 5, protrusion; 6, vent hole; 7, anti-slip line; 8, air hole; 9, anti-slip bushing; 10, barbell bar; 11, barbell weight.

DETAILED DESCRIPTION OF THE INVENTION

Embodiment 1: As shown in FIG. 1-FIG. 5, an auxiliary tool for barbells comprises a sleeve 1 which is composed of a first sleeve 11, a second sleeve 12, a third sleeve 13, a first sleeve wall 21, a second sleeve wall 22 and a third sleeve wall 23, wherein the first sleeve wall 21 is sequentially connected to the second sleeve wall 22 and the third sleeve wall 23 to form a complete sleeve cavity 4, the first sleeve wall 21 and the third sleeve wall 23 cover at least one part of a barbell bar 10, and the second sleeve wall 22 expands outwards in the sleeve cavity 4 to form an inner cavity 41; when the barbell bar 10 is sequentially inserted into the first sleeve 11, the second sleeve 12 and the third sleeve 13 from a sleeve opening, the inner cavity 41 is filled with gas to form a crush-resistant cavity; and protrusions 5 are formed in an inner wall of the third sleeve 13, and a vent hole 6 is formed in a bottom wall of the third sleeve 13.

In a preferred embodiment of the invention, as shown in FIG. 1-FIG. 5, the first sleeve wall 21, the second sleeve wall 22 and the third sleeve wall 23 are formed integrally, which is a simple process, such that the auxiliary tool can be obtained quickly; the wall thickness of the first sleeve wall 21 increases gradually towards the second sleeve wall 22, such that the structural strength of the joint of the first sleeve wall 21 and the second sleeve wall 22 can be improved, and the first sleeve wall 21 and the second sleeve wall 22 are not prone to breakage when the barbell bar 10 is inserted into the first sleeve wall 21 and the second sleeve wall 22.

In a preferred embodiment of the invention, the sleeve 1 is made of rubber. By means of the properties of rubber, the damage of a barbell to the ground during training can be reduced, and the service life of the auxiliary tool for barbells is prolonged. When the barbell bar 10 is sequentially inserted into the first sleeve 11, the second sleeve 12 and the third sleeve 13, the inner cavity 41 forms the crush-resistant cavity full of gas, which can effectively buffer the pressure applied to the ground by the barbell during training to reduce damage to the ground and can also protect the end of the barbell bar 10 sleeved with the auxiliary tool.

In a preferred embodiment of the invention, anti-slip lines 7 are disposed on an outer wall of the sleeve 1, and the anti-slip lines 7 are preferably honeycomb-shaped. The anti-slip lines 7 can effectively increase the friction between the auxiliary tool and the ground during training, such that slipping is avoided during training, which may otherwise affect the training effect; by adoption of the honeycomb-shaped structural design, a negative pressure will be formed in the honeycomb socket by the deformation of the axillary tool when the outer wall of the sleeve 1 contacts the ground when the auxiliary tool is used for training on the smooth ground, such that the auxiliary tool can be easily adhered to the smooth ground, and the phenomenon that slipping is likely to happen when the auxiliary tool is used for training on the smooth ground is avoided.

In a preferred embodiment of the invention, the protrusions 5 are formed on the inner wall of the third sleeve. The protrusions 5 can increase the friction of the end of the barbell bar 10 in the third sleeve 13, such that the barbell bar 10 is prevented from rotating or slipping with respect to the auxiliary tool. The inner diameter of the air hole 8 is less than that of the vent hole 6, such that gas in the sleeve 1 can be discharged more smoothly, and the barbell bar 10 can be inserted into the sleeve 1 more easily.

Embodiment 2: as shown in FIG. 1-FIG. 5, an anti-slip method for barbells during use comprises the following steps: an anti-slip bushing 9 is provided and is disposed around one end of a barbell bar 10, and a pressurizing cavity 41 is disposed on a middle section of the anti-slip bushing 9; when the barbell bar 10 is inserted into the bottom of the anti-slip bushing 9, the pressurizing cavity 41 is full of gas to enable a portion, corresponding to the pressurizing cavity 41, of the outer surface of the anti-slip bushing 9 contact the ground, such that the end of the barbell bar 10 is prevented from directly applying a pressure to the anti-slip bushing 9; and anti-slip lines 7 are disposed on the outer surface of the anti-slip bushing 9 to increase the friction between the anti-slip bushing 9 and the ground, such that an anti-slip effect is realized.

Figure 5:
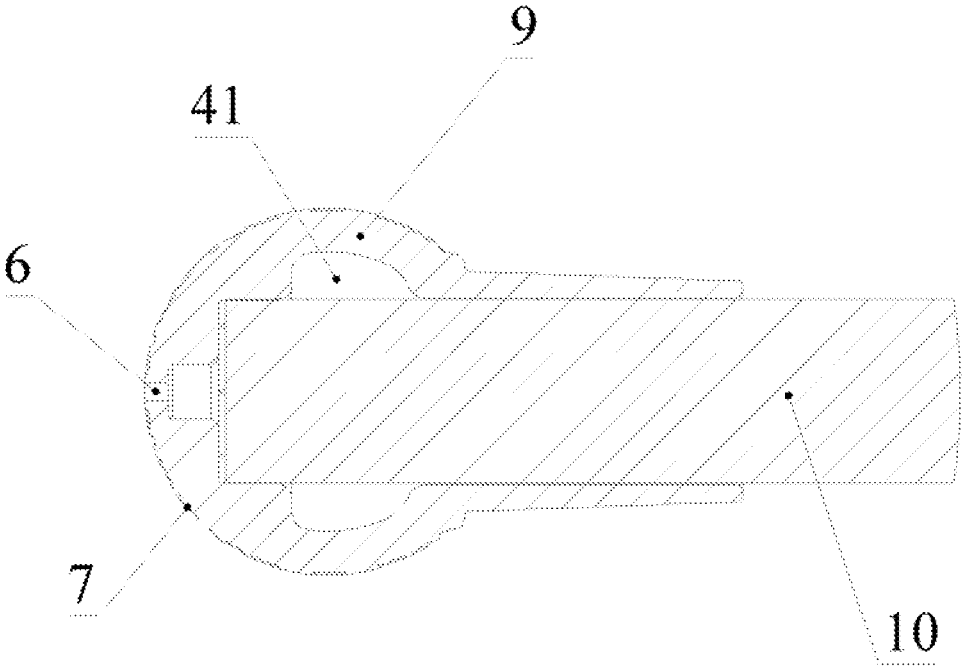
FIG. 5 is an enlarged view of part B in FIG. 4.
Figure 6:
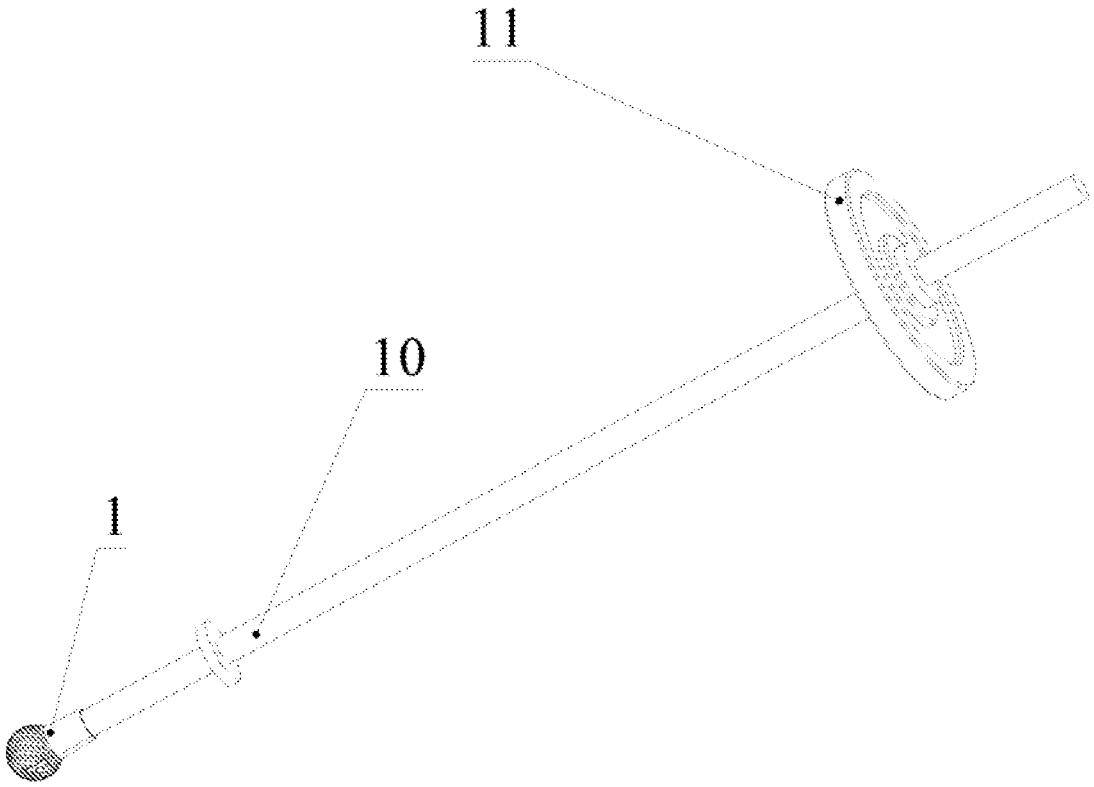
FIG. 6 is a schematic diagram of the auxiliary tool for barbells and a barbell bar used together according to the invention.

As shown in FIG. 5, during training, the auxiliary tool is placed on the ground as a fulcrum, and a proper barbell weight 10 is fixed to the other end, away from the auxiliary tool, of the barbell bar; and trainers hold the barbell bar 10 near the barbell weight 10 to make various lifting motions to fulfill the purpose of training.

Embodiment 3: According to the auxiliary tool in Embodiment 1, the sleeve 1 is made of silicone.

Embodiment 4: According to the auxiliary tool in Embodiment 1, the anti-slip lines 7 are striped.

The above embodiments are merely preferred ones of the invention, and are not used to limit the invention. Various modifications and changes can be made to the invention by those skilled in the art. Any amendments, equivalent substitutions and improvements made based on the spirit and principle of the invention should fall within the protection scope of the invention.

What is claimed is:

1. An auxiliary tool for barbells, the tool comprising a sleeve which is composed of a first sleeve, a second sleeve, a third sleeve, a first sleeve wall, a second sleeve wall and a third sleeve wall, wherein the first sleeve wall is sequentially connected to the second sleeve wall and the third sleeve wall to form a complete sleeve cavity, the first sleeve wall and the third sleeve wall cover at least one part of a barbell bar, and the second sleeve wall expands outwards in the sleeve cavity to form an inner cavity; wherein when the barbell bar is sequentially inserted through a sleeve opening into the first sleeve, the second sleeve and the third sleeve, the inner cavity is filled with gas to form a crush-resistant cavity; and wherein protrusions are formed on an inner wall of the third sleeve, and a vent hole is formed in a bottom wall of the third sleeve.

2. The auxiliary tool for barbells according to claim 1, wherein the first sleeve wall, the second sleeve wall and the third sleeve wall are formed integrally, and a wall thickness of the first sleeve wall increases gradually towards the second sleeve wall.

3. The auxiliary tool for barbells according to claim 2, wherein the sleeve is made of an elastic material.

4. The auxiliary tool for barbells according to claim 1, wherein the sleeve is made of an elastic material.

5. The auxiliary tool for barbells according to claim 4, wherein anti-slip lines are disposed on an outer wall of the sleeve.

6. The auxiliary tool for barbells according to claim 5, wherein the anti-slip lines are honeycomb-shaped or striped.

7. The auxiliary tool for barbells according to claim 1, wherein an air hole communicated with the vent hole in the bottom wall of the third sleeve is formed in an outer wall of the sleeve, and an inner diameter of the air hole is less than that of the vent hole.

8. An anti-slip method for barbells during use, the method comprising providing an anti-slip bushing, disposing the anti-slip bushing around an end of a barbell bar, and forming a pressurizing cavity in a middle section of the anti-slip bushing; when the barbell bar is inserted into a bottom of the anti-slip bushing, filling the pressurizing cavity with gas to enable a portion, corresponding to the pressurizing cavity, of an outer surface of the anti-slip bushing to contact a ground, such that the end of the barbell bar is prevented from directly applying a pressure to the anti-slip bushing; and disposing anti-slip lines on the outer surface of the anti-slip bushing to increase the friction between the anti-slip bushing and the ground, such that an anti-slip effect is realized.

9. The anti-slip method for barbells during use according to claim 8, wherein the anti-slip bushing is formed integrally.

10. The anti-slip method for barbells during use according to claim 8, wherein a vent hole is formed in a bottom of the anti-slip bushing.

11. The anti-slip method for barbells during use according to claim 9, wherein a vent hole is formed in a bottom of the anti-slip bushing.

* * * * *